United States Patent [19]

Benetello

[11] 4,067,311

[45] Jan. 10, 1978

[54] METHOD FOR SAWING HARD MATERIAL

[76] Inventor: Giorgio Benetello, Via S. Rosa, 46, Padova, Italy

[21] Appl. No.: 788,488

[22] Filed: Apr. 18, 1977

Related U.S. Application Data

[63] Continuation-in-part of Ser. No. 607,639, Aug. 25, 1975, abandoned.

[30] Foreign Application Priority Data

Aug. 29, 1974 Italy ..... 41666/74

[51] Int. Cl.[2] ..... B28D 1/04

[52] U.S. Cl. ..... 125/13 R; 51/206.4; 51/283 R; 125/15

[58] Field of Search ..... 125/13, 15; 51/206.4, 51/283

[56] References Cited

U.S. PATENT DOCUMENTS

| | | | |
|---|---|---|---|
| 3,338,230 | 8/1967 | Lindwad | 125/15 |
| 3,498,283 | 3/1970 | Cook | 125/15 |
| 3,517,463 | 6/1970 | Niemic | 125/15 X |

FOREIGN PATENT DOCUMENTS

| | | | |
|---|---|---|---|
| 265,789 | 1/1971 | U.S.S.R. | 125/15 |

*Primary Examiner*—Harold D. Whitehead

*Attorney, Agent, or Firm*—Guido Modiano; Albert Josif

[57] ABSTRACT

A method for sawing hard material with circular abrasive disc saws of the kind having secured to the periphery of the disc arcuated cutting segments of bonded diamond abrasives, in which conventional speed of rotation of the abrasive disc, cutting depth of the disc and longitudinal feed are selected for abrasive disc. On the arcuated cutting segments of bonded diamond abrasives an effective total peripheral cutting surface consisting of the sum of the cutting surfaces of the single arcuated segments is provided having along a peripheral circumference an optimum average number of cutting points of the bonded diamond abrasive per one millimeter width as determined as a function of the ratio of the selected longitudinal feed and the product of an average incision depth made by a single diamond point.

3 Claims, 3 Drawing Figures

METHOD FOR SAWING HARD MATERIAL

CROSS-REFERENCE TO RELATED APPLICATIONS

This is a continuation-in-part application of my parent patent application Ser. No. 607,639, filed on August 25, 1975 and now abandoned.

BACKGROUND OF THE INVENTION

This invention relates to a method for sawing hard material with circular abrasive disc saws of the kind having secured to the periphery of the disc arcuated cutting segments of bonded diamond abrasives.

The present-day art of sawing granite or hard rock in general, does not allow large-depth cuts to be made in a single pass for various reasons which will be described hereinafter, and this operation is carried out by a succession of small-depth passes.

The great advantages obtained by cutting marble and soft rock with diamond discs and diamond bladed frames in a single deep pass are, on the other hand, well known.

To overcome this difficulty with hard stone, the art has directed itself towards a search for new sawing methods using diamond discs or blades, but the results up to the present time have been poor because of various problems which have arisen.

Such rock is sawn with machines provided with disc tools comprising on their peripheral rim a plurality of teeth on which arcuated cutting segments are carried, consisting of bonded abrasive material, normally a sintered material, containing preferably diamonds of various concentrations and sizes, supported by a binder of suitable hardness.

In practice, in the present-day art, the concentration of the diamond present in the cutting element is increased and the resistance of the binder is reduced in accordance with the hardness of the material to be cut, i.e. the greater the hardness, the greater the diamond concentration.

In this manner, the diamonds on the cutting surface are quickly renewed, and thus the cutting surface itself is rapidly self-sharpening. This evidently leads to rapid wear of the tools and consequent high manufacturing costs. However as soon as harder binders were used it was found that the cutting surface tended to flatten off and become clogged, and in order to re-sharpen it the pressure exerted by the machine on the block to be cut had to be increased. This increase in pressure resulted in a stress increase in the metal core of the disc, which became subjected to a point load.

The stress limits are obviously related to the thickness of the metal core, and if the diameter of the disc or the load are increased in order to make deep passes, the thickness of the metal core must also be increased. The primary disadvantage of this increase in thickness is the need to provide wider and therefore more costly cutting segments, and a further considerable disadvantage is the greater loss of material in the cutting operation and a corresponding reduction in the use ratio of the material itself, which results in a cost increase of the final product.

Furthermore, the core thickness is not conditional on the mechanical strength as such, because the stage which precedes the actual fracture, consisting in the elastic deformation of the disc, is itself not acceptable. In this case, the surfaces obtained would be no longer flat but undulated, and subsequent facing operations would be necessary.

The known art is evidently more extensive than this, and an attempt has been made to exemplify it briefly to show the problems concerned.

More information as to the problems incountered in using abrasive discs for cutting hard rocks are found in publications of large manufacturing companies such as De Beers or the publication Granit International sponsored by Ernst Winter and Sohn GmbH & Co. of Hamburg West Germany, or from catalogues of these companies in which instructions are given to the users of the diamond discs.

The main object of the present invention is to eliminate the aforementioned disadvantages of the known art by providing a method of cutting hard material such as granite or hard rock with abrasive disc saws which allows a deep cut in a single pass to be made, and which gives a finished product not requiring further facing operations.

A further object is to provide a method through which the cutting edge become self-sharpening without requiring excessive working loads, so giving long life to the cutting edges.

A further object is to provide a method in which discs with a small thickness core may be used, even in case of discs of large diameter, leading to cutting segments of small cross-section and low material losses during working.

A further object is to provide a method in which good diamond utilisation and an economical cutting operation is obtained, and which may be used with the usual machines normally available on sites of this type.

Applicant has found that contrary to the general belief according to which in the case of hard rocks such as granites the concentration of diamonds should increase with the increase in the cutting depth of the disc, such concentration should instead be decreased with the increase in the cutting depth, when all other conditions of the cutting operation are maintained unchanged when the starting concentration is adequate for small depths cuts.

The problem to be solved was therefore to find out the optimum diamond concentration for a given cutting depth.

SUMMARY OF THE INVENTION

The applicant has found that decisive indications for attaining the above mentioned objects may be obtained from an analysis of the behaviour of a single diamond point during the cutting action of the disc.

Attempts have been already made to analyse the cutting forces acting on single diamond points but it was extremly difficult to determine the exact value of these forces owing to a great many factors influencing the same.

Applicant has found in observing the behaviour of single diamond points in a great many of tests carried out, that the cutting energy involving a single diamond point during the cutting operation should not exceed a determined level and should not be lower than a predetermined level, in order to obtain simultaneously the best cutting efficiency and the minimum wear.

The Applicant has found further that best practical results are obtained if the average incisions made by a single diamond point into the material to be cut are accurately considered as a parameter during the cutting action of diamond discs in a great many of test and under different operative conditions. As a consequence of these observations the applicant has found that there exist a optimum range of values of the degree of incision made by a single diamond point of the bonded abrasive disc in the presence of which an optimum cutting efficiency of the diamond disc, a minimum wear and energy consumption and an optimum cutting face in the cut material is obtained. The life of the diamond disc is remarkably increased if the cutting operation is carried out under conditions in which the above critical value range is maintained.

Such optimum range of values may be considered to be also of critical nature.

According to the invention there is provided a method for sawing hard material with circular abrasive disc saws of the kind having secured to the periphery of the disc arcuated cutting segments of bonded diamond abrasives, comprising the steps of:

selecting a speed of rotation of the abrasive disc;

selecting a cutting depth of the disc;

selecting a longitudinal feed for said abrasive disc;

providing on said arcuated cutting segments of bonded diamond abrasives an effective total peripheral cutting surface consisting of the sum of the cutting surfaces of the single arcuated segments and having along a peripheral circumference an optimum average number of cutting points of the bonded diamond abrasive per one millimeter width as determined by the following formula:

$$z = (a/a_z \cdot n)$$

where:

$z$ is the said optimum average number of cutting points of the bonded diamond abrasive per one millimeter width along the peripheral circumference, $a$ is said selected longitudinal feed expressed in microns per minute, $n$ is said selected speed of rotation of the abrasive disc expressed in rounds per minute, $a_z$ is a prestablished parameter indicating the average specific optimum incision depth expressed in microns and cut into the material to be cut by one single average cutting point of the bonded diamond abrasive during $n$ revolution of the disc and with said selected longitudinal feed thereof, and wherein said preestablished parameter of average specific optimum incision depth is in the range of from about 2.5 to about 3.5, and cutting the hard material with said so provided optimum number of cutting points and with said selected longitudinal feed and said selected speed of rotation of the abrasive disc and with said selected cutting depth.

The selected speed of rotation of the disc and the selected longitudinal feed may be those normally advised by the manufacturer of the disc used.

According to the method of this invention it is decisive to determine the average number of points of diamond on the surface of the bonded abrasive material. Such number of diamond points is normally not indicated in the present day catalogues of the manufacturers of the abrasive material and the count must be presently made by the user himself.

Once the average number of diamond points per one millimeter width over the entire segmented periphery of the disc has been determined a comparison is made with the optimum number of such points calculated from the above formula on the basis of the selected longitudinal feed and speed of rotation of the disc and selecting a value of $a_z$ within the claimed optimum range taking into account that better results are obtained if lower values of $a_z$ are selected for harder rocks and vice versa. If the number of points is in excess with respect to the calculated optimum number, area portions of the abrasive material are removed from each segment preferably in a uniform manner so that the total number of points corresponds to the calculated optimum number. In certain cases some of the abrasive segments may be removed uniformly over the periphery of the disc. In certain cases it may be convenient to select a disc with a more suitable concentration of diamonds on the surface of the abrasive material. If the number of diamond points is lower than the optimum number the total surface area of the abrasive segments may be increased by adding some abrasive segments or by increasing the effective surface of the segments e.g. by replacing the prefabricated abrasive segments by other abrasive segments having a greater peripheral extension. The manner in which this is done is well known in the art.

In describing this correlation, it is presupposed that it refers to determined operating conditions such as peripheral speeds and applied loads, in that these are parameters imposed both by the machine in use and by the sawing system adopted.

BRIEF DESCRIPTION OF THE DRAWINGS

Further characteristics and advantages of the invention will be more evident from a preferred but not exclusive embodiment of the invention, illustrated by way of example in the accompanying drawing in which.

DESCRIPTION OF A PREFERRED EMBODIMENT

Figure 1:
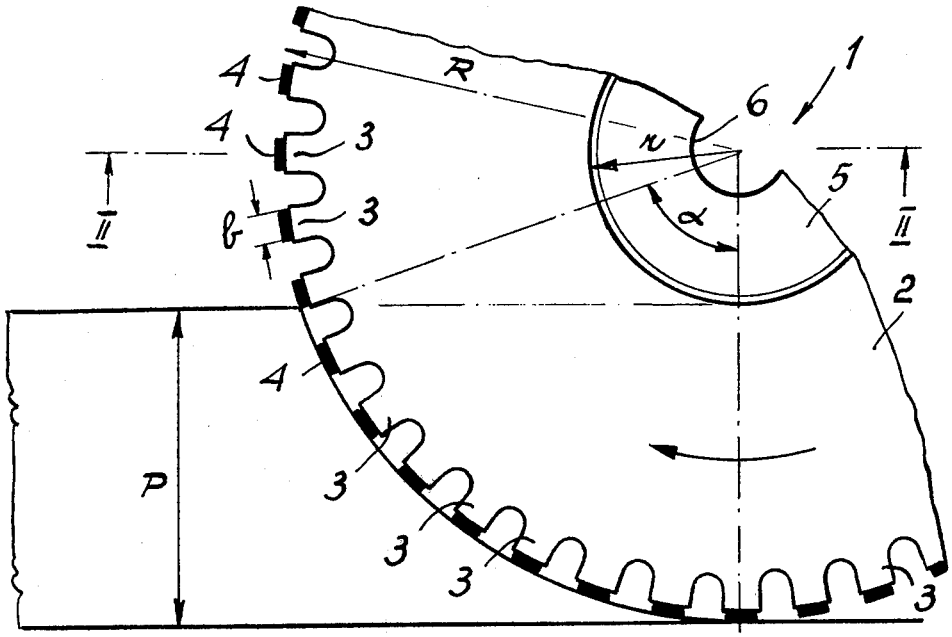
FIG. 1 is a side view of a diamond discs.
Figure 2:
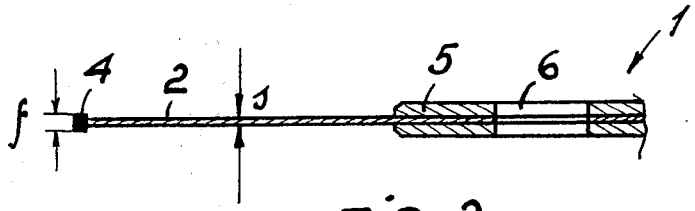
FIG. 2 is a section on the line II—II of the diamond disc of FIG. 1.
Figure 3:
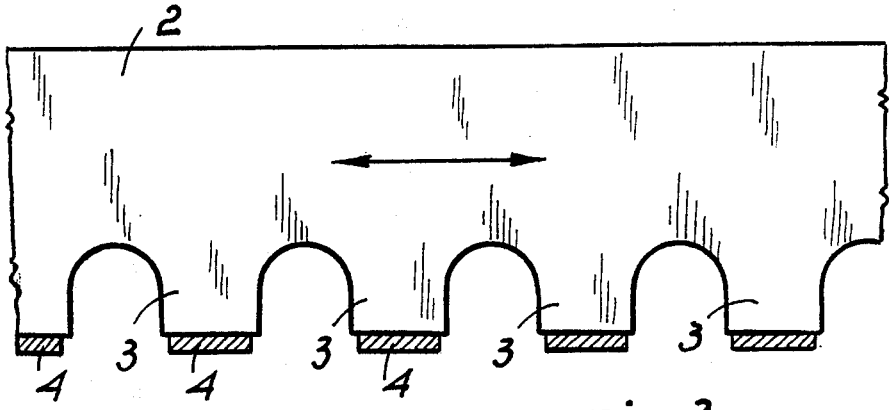
FIG. 3 is a diamond blade for saw frames.

With reference to the said figures, the diamond disc 1 (or the diamond blade) consists of a metal core 2 shaped in such a manner as to present a plurality of teeth 3 in its perimetral part.

On the teeth 3 are mounted arcuated cutting segments 4 — more particularly a sintered compound — consisting of a binder and diamond crystals.

The central region of the metal core is reinforced with a flange 5 comprising a bore 6 for the machine axle.

The overall radius of the diamond disc is indicated by R, the radius of the flange by $r$ and the maximum cutting depth, R-$r$, by P. The angle at the centre of the circular sector in cutting engagement is indicated by $\alpha$. If N is the total number of teeth in the disc, $f$ the width of the cutting element and $b$ its length, the number $n_e$ of teeth engaged is $$n_e = (N/2\pi)\alpha$$

and thus the total working surface area is $$f.b.n_e = f.b.\ (N/2\pi)\alpha$$

The operating principle of this diamond disc is as follows: the thrust exerted by the machine axle on the disc is divided over the $n_e$ teeth engaged, or rather over a number of diamond points distributed over the total surface area of the $n_e$ teeth. The number of diamond points present depends in its turn on the total surface area of contact and the diamond concentration in the cutting element.

The optimum force which must act on a single point for it to work under the best conditions, for a given peripheral operational speed, is known in the art. On this basis, as the force acting on the disc is predetermined, being a characteristic of the machine, and the operating speed of the cutting edge is fixed, said force must always act on the same number of points in cutting engagement. As the disc diameter and therefore the depth of cut are increased, the number of points in cutting engagement can be kept constant in various ways:

1. The diamond percentage or concentration in the cutting segment may be kept constant; in this case the acting surface $f.b.n_e$ must be kept constant either by keeping the number and shape of the cutting edges constant or by increasing the number of teeth and consequently reducing the dimension B, i.e. the lenght of the cutting segment.

2. The shape of individual teeth is kept constant; in this case the number of points must be kept constant either by reducing the number of teeth or by reducing the diamond concentration in the said cutting segment.

It is evident that the two methods may be used simultaneously acting on all parameters to obtain the indispensable result of keeping the number of diamond points simultaneously in cutting engagement constant.

By way of example, if a normal commercial disc for cutting soft stone, i.e. marble, is considered having a diameter of 725 mm and consisting of 40 cutting sectors of 40 mm. length, the number of points present must be reduced by 1/10 using one of the aforementioned methods in order to cut a soft granite according to the classification in use (ASSO DIAM classification). It is thus evident that the proposed objects are attained by providing a disc capable of making deep cuts in a single pass, with obvious advantages.

As the global force acting is kept constant, it is not necessary to thicken the core.

It can also be seen that the number of diamonds acting is maintained and their wear is reduced, making it possible to use a hard binder without compromising self-sharpening.

Finally, this type of disc may be used on machines of normal characteristics.

EXAMPLES

From the following examples the characteristics and advantages of this invention may be appreciated.

The examples are illustrated on the basis of the following tables in which the column numbers indicate the following:

I — Number of test
II — Total number of diamond points
III — Width of the segment in mm.
IV — Number of points along a one millimeter wide periphery circumference
V — Valve of $a_z$ as above defined
VI — Consumption of electric energy expressed in amperes at 380 Volts
VII — Quality of the sawed faces
VIII — Wear of segments
IX — Remarks

TABLE I

| I | II | III | IV | V | VI | VII | VIII | IX |
|---|---|---|---|---|---|---|---|---|
| 1* | 4 800 | mm. 8 | 600 | 0,7 | Initially 20 A. | twisted | No wear tests | |
| 2* | 4 000 | mm. 8 | 500 | 0,8 | test interrupted | " | possible since | No self-sharpening |
| 3* | 3 000 | mm. 8 | 375 | 1,1 | after few minutes | " | test were inter- | of segments |
| 4* | 2 400 | mm. 8 | 300 | 1,4 | with 60 A. | " | 4 ÷ 8 m² | |
| 5* | 1 400 | mm. 8 | 175 | 2,4 | about 30 A. | intensly grooved | mean | difficult irregular self-sharpening |
| 6* | 1 200 | mm. 8 | 150 | 2,8 | 25 A. | regular | optimum | 1 mm radial per 105m² sawn |
| 7* | 1 000 | mm. 8 | 125 | 3,3 | 20 A. | " | high | 1 mm radial/56m² |
| 8* | 800 | mm. 8 | 100 | 4,1 | 15 A. | " | high | 1 mm radial/25m² |

TABLE I - Series of soft granites (low quartz content)
Disc diameter 1200 mmL6 Number of segments 80 length: width and hight of each segment 24×8×5 mm
Longitudinal feed - 20 cm/min
r.p.m. - 480
cutting depth - 40 cm

TABLE II

| I | II | III | IV | V | VI | VII | VIII | IX |
|---|---|---|---|---|---|---|---|---|
| 9 | 5 600 | 8 | 700 | 0,4 | Initially 20 A. | twisted | Test | |
| 10 | 4 000 | 8 | 500 | 0,6 | test interrupted | " | interrupted | No self-sharpening |
| 11 | 3 000 | 8 | 375 | 0,8 | after few minutes | " | after 4 ÷ 8 m² | of segments |
| 12 | 2 000 | 8 | 250 | 1,2 | with 60 A. | " | | |
| 13 | 1 400 | 8 | 175 | 1,8 | 30 A. | intensly grooved | mean | difficult irregular self-sharpening |
| 14 | 1 000 | 8 | 125 | 2,5 | 25 A. | regular | optimum | 70 m² per 1 mm |
| 15 | 800 | 8 | 100 | 3,1 | 20 A. | " | high | 38 m² per 1 mm |
| 16 | 600 | 8 | 75 | 4,1 | 15 A. | " | high | 18 m² per 1 mm |

TABLE 2 - Series of granites of medium hardness (high content of quartz)
Disc diameter 1200 mm
Segments as in table I
Longitudinal feed - 12.5 cm/min
r.p.m. - 400
cutting depth - 40 cm

TABLE III

| I | II | III | IV | V | VI | VII | VIII | IX |
|---|---|---|---|---|---|---|---|---|
| 17 | 2 200 | 5 | 440 | 0,9 | Initially 10 A. | twisted | | No self-sharpening |
| 18 | 1 400 | 5 | 280 | 1,5 | test interrupted | " | | of segments |

TABLE III-continued

| I | II | III | IV | V | VI | VII | VIII | IX |
|---|---|---|---|---|---|---|---|---|
| 19 | 1 200 | 5 | 240 | 1,7 | after few minutes with 40 A. | " | | |
| 20 | 900 | 5 | 180 | 2,3 | 12 A. | intensly grooved | mean | difficult irregular self-sharpening |
| 21 | 750 | 5 | 150 | 2,8 | 10 A. | regular | optimum | 1 $mm_2$radial per 98 m |
| 22 | 600 | 5 | 120 | 3,4 | 10 A. | " | high | 1 mm radial/55 $m^2$ |
| 23 | 500 | 5 | 100 | 4,1 | 10 A. | " | high | 1 mm radial/26 $m^2$ |

TABLE 3 - Series of soft granites (low quartz content)
Disc diameter - 600 mm
Number of segments - 36 length width and hight of each segment 40×5×4 mm
Longitudinal feed - 40 cm/min
r.p.m. - 960
cutting depth - 20 cm

TABLE IV

| I | II | III | IV | V | VI | VII | VIII | IX |
|---|---|---|---|---|---|---|---|---|
| 24 | 2 600 | 5 | 520 | 0,6 | Initially 10 A. | twisted | Test inter- | No self-sharpening |
| 25 | 1 000 | 5 | 200 | 1,5 | test interrupted | " | rupted after | of segments |
| 26 | 800 | 5 | 160 | 2 | with 40 A. | " | 4 ÷ 8 $m^2$ | |
| 27 | 700 | 5 | 140 | 2,2 | 12 A. | intensly grooved | mean | difficult self-sharpening |
| 28 | 600 | 5 | 120 | 2,6 | 10 A. | regular | optimum | 1 mm radial/65 $m^2$ |
| 29 | 500 | 5 | 100 | 3,1 | " | " | high | 1 mm radial/40 $m^2$ |
| 30 | 400 | 5 | 80 | 3,9 | " | " | high | 1 mm radial/19 $m^2$ |

TABLE 4 - Series of granites of medium hardness (high quartz content)
Disc diameter - 600 mm
Segments as in table 3
Longitudinal feed - 25 cm/min
r.p.m. - 800
cutting depth - 20 cm

TABLE V

| I | II | III | IV | V | VI | VII | VII | IX |
|---|---|---|---|---|---|---|---|---|
| 31 | 2 800 | 5 | 560 | 0.84 | | | | no cutting action |
| 32 | 660 | 5 | 132 | 3,5 | | regular | 1 mm/170 $m^2$ | very efficient cutting |

TABLE 5 - Series of soft granites (low quartz content Beola granite)
Disc diameter - 550 mm
Longitudinal feed - 44 cm/min
r.p.m. - 940
cutting depth 18 cm The classification and denomination of the granites used in the tests is according to ASSODIAM Standards(National Association of Manufactures, Merchants and Distributors of Diamond Bearing Tools of Milan/Italy).

In the tests of Tables 1 and 3 a granite named Nero Africa (Africa Black) was used. In the tests of Tables 2 and 4 granites named Rosa Sardo (Sardinia Pink) were used. In Table 5 a granite named Beola has been used.

The number of diamond points have been counted on the surface of bonded diamond abrasive material. The following concentration (number of points per $cm^2$) has been found:

31 — On the abrasive material used in the tests of Table 1

36 — On the abrasive material used in the tests of Table 2

30.5 — On the abrasive material used in the tests of Table 3

36 — On the abrasive material used in the tests of Table 4

42 — On the abrasive material used in the tests of Table 5

The counting has been made on 10 different areas of each abrasive material and the mean value of concentration has been adopted.

The longitudinal feed and the speed of rotation have been selected on the basis of the standards of ASSODIAM for the tested granites.

From the tests carried out it appears clear that the range of optimum values of the parameter $a_z$ is between 2.5 and 3.5 and that for high quartz content granites lower values of the parameter and for low quartz content granites higher vaues of the said parameter within the indicated range are suitable for the calculation of the optimum number of points of an abrasive disc to be used for the cutting operation according to this invention.

I claim:

1. A method for sawing hard material with circular abrasive disc saws of the kind having secured to the periphery of the disc arcuated cutting segments of bonded diamond abrasives, comprising the steps of:

selecting a speed of rotation of the abrasive disc;

selecting a cutting depth of the disc;

selecting a longitudinal feed for said abrasive disc;

providing on said arcuated cutting segments of bonded diamond abrasives an effective total peripheral cutting surface consisting of the sum of the cutting surfaces of the single arcuated segments and having along a peripheral circumference an optimum average number of cutting points of the bonded diamond abrasive per one millimeter width as determined by the following formula:

$$z = (a/a_z \cdot n)$$

where:

$z$ is the said optimum average number of cutting points of the bonded diamond abrasive per one millimeter width along the peripheral circumference, $a$ is said selected longitudinal feed expressed in microns per minute, $n$ is said selected speed of rotation of the abrasive disc expressed in rounds per minute, $a_z$ is a preestablished parameter indicating the average specific optimum incision depth expressed in microns and cut into the material to be cut by one single average cutting point of the bonded diamond abrasive during $n$ revolutions of the disc and with said selected longitudinal feed thereof, and wherein said preestablished parameter of average specific optimum incision depth is in the range of from about 2.5 to about 3.5, and cutting the hard material with said so provided optimum number of cutting points and with said selected longitudinal feed and said selected speed of rotation of the abrasive disc and with said selected cutting depth.

2. A method according to claim 1, wherein $a_z$ is between about 2.5 and about 2.6 when sawing high quartz content granites.

3. A method according to claim 1, wherein $a_z$ is from about 2.8 to about 3.5 when sawing low quartz content granites.

* * * * *